US005131193A

United States Patent [19]

Demers

[11] Patent Number: 5,131,193

[45] Date of Patent: Jul. 21, 1992

[54] CONTOUR SANDING DEVICE

[76] Inventor: Michael J. Demers, 75 Cambridge St., Lawrence, Mass. 01843

[21] Appl. No.: 676,327

[22] Filed: Apr. 25, 1991

Related U.S. Application Data

[63] Continuation-in-part of Ser. No. 320,173, Mar. 7, 1989, abandoned.

[51] Int. Cl.[5] ..... B24D 15/00

[52] U.S. Cl. ..... 51/391; 51/392; 51/358

[58] Field of Search ..... 51/391, 392, DIG. 14, 51/358, 363, 372, 400, 401

[56] References Cited

U.S. PATENT DOCUMENTS

| | | | |
|---|---|---|---|
| 2,112,593 | 3/1938 | Campbell | 51/392 X |
| 2,220,727 | 11/1940 | Nordlund | 51/392 X |
| 2,435,335 | 2/1948 | Andrews | 51/393 X |
| 3,089,294 | 5/1963 | Cowley | 51/358 X |

FOREIGN PATENT DOCUMENTS

| | | | |
|---|---|---|---|
| 0774465 | 5/1957 | United Kingdom | 51/391 |

*Primary Examiner*—M. Rachuba
*Attorney, Agent, or Firm*—Edward A. Gordon

[57] ABSTRACT

A manually usable device for abrading a profiled surface contour including an elongated rigid body having an upper portion of a size and shape that may be held and effectively used with a user's single hand and a lower elongated portion coextensive with the upper portion. The lower portion is constructed and arranged to terminate in a predetermined profiled exterior surface contour abrading section adapted to receive an abrasive material thereon whereby the profiled surface contour matches the profiled surface contour to be abraded. The lower portion has a cross-section transverse to the length which tapers from the profiled surface contour to the upper portion with the upper and lower portions being unitary in cross-section. The surface contour abrading section is constructed and arranged to be oversized with respect to a convex-like surface contour section to be abraded or undersized with respect to a concave-like surface contour section to be abraded to thereby provide an interposed space therebetween of predetermined thickness. An abrading member is provided with an upper non-abrasive surface for attachment to the surface contour abrading section and a lower abrasive surface for contact with the profiled surface contour section to be abraded and has a predetermined overall thickness substantially equal to the interposed space.

10 Claims, 3 Drawing Sheets

FIG.9
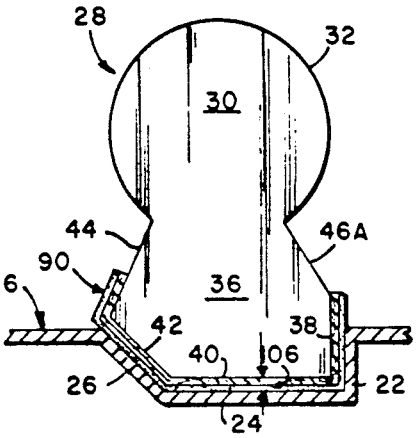
FIG.10
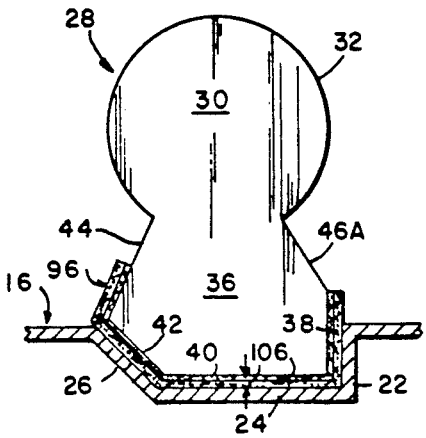
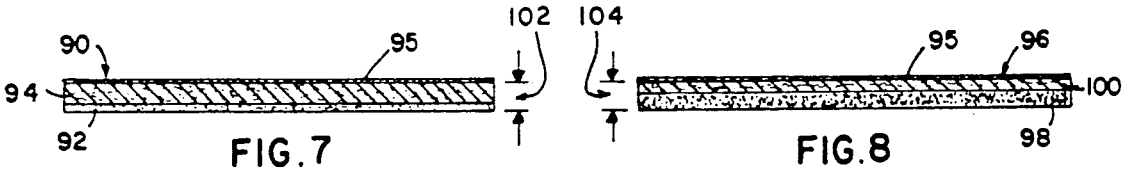
FIG.7
FIG.8
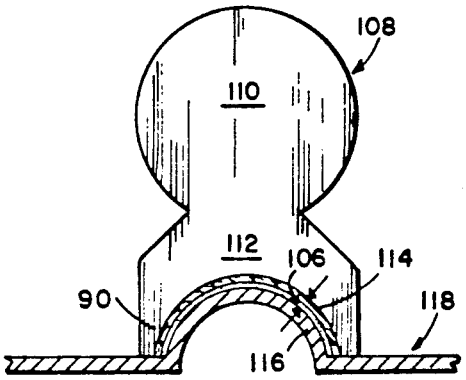
FIG.11

CONTOUR SANDING DEVICE

This application is a continuation-in-part of application Ser. No. 07/320,173 filed Mar. 7, 1989.

BACKGROUND OF THE INVENTION

1. Field Of The Invention

The present invention relates to abrading devices for roughening, smoothing, polishing, sanding and finishing surfaces and more particularly to a new and improved manual contour sanding or finishing device or tool and abrasive material structure.

2. Description Of Prior Art

There are numerous devices in the prior art for sanding or grinding contoured surfaces. For example, for sanding or grinding the surfaces of moldings having a profiled surface contour or cross-section and for sanding or grinding the edge surfaces of panel type work pieces, tools are required which have a counter profile matching with the surface configuration or profile to be finished. The counter or matching profile of the tool is coated with the grinding material. It is known to make such sanding or grinding or finishing tools of rubber, cork or similar materials, whereby the counter or matching profile is machined into the tool, for example, by a grinding operation. Thereafter, a grinding cloth is secured to the machined surface of the tool, for example, by an adhesive bonding.

In U.S. Pat. No. 4,535,574 there is disclosed an example of a prior art sanding tool and method of making the same. As disclosed, the tool is manufactured in a foaming mold which is equipped with at least one inwardly facing profiled surface configuration corresponding to that of the molding for which the tool is intended. The grinding material is then applied to the profiled surface in the mold. A curable foam is then filled into the mold and the mold is closed to permit the curing of the foam material, whereby the abrasive or finishing material is intimately bonded to the cured foam material along the profiled surface configuration. When the tool is removed from the mold it is substantially a finished tool ready for use.

U.S. Pat. Nos. 470,794; 1,062,214 and 1,570,177 each disclose various forms of sanding blocks having a plurality of plates which are adjustably mounted so that they will extend variable distances to conform generally with the configuration of the surface to be worked upon with sanding paper attached to the configured plate surface.

U.S. Pat. No. 2,220,727 discloses a holder for an abrasive sheet comprising a pair of members, the adjacent faces of the members being flat, and the sheet enclosing the lower member and having its ends overlying the flat face thereof. Elongated rod members are provided to resist relative lateral displacement of the upper and lower members when in superposed relationship. A clamp is provided to draw the upper and lower members into pressure abutment with the ends of the sheet whereby the sheet ends will conform to the contour between the upper and lower members and be secured against displacement.

U.S. Pat. No. 2,982,059 discloses a hand sander for flat and variously curved surfaces in which a sandpaper sleeve is slipped over a U-shaped holder whereby the flexible side walls and open side of the holder permits the sandpaper to be deflected to fit various curved surfaces.

The state of the art is also believed to be exemplified by the following patents: U.S. Pat. Nos. 2,112,593; 2,435,335; 3,089,294 and English Patent 774,465.

In many applications, and more especially with regard to the repair of modern automobile bodies, elongated concave grooves also known as a body line, for example, must be abraded for removing unwanted filling material and smoothing prior to finishing. In the past, automobile body panels were generally constructed of thicker or heavy gauge metals and did not require the use of body lines to provide structural strength to the body panels. In present day automobiles as in the recent past, automobiles are manufactured using thinner and lighter gauge metals for both economical and operational reasons. Thinner gauge metal panels reduce the manufacturing cost. Additionally the resulting reduction in weight of the automobile permits the use of smaller engines with improved fuel efficiency.

In order for manufacturers of automobiles to employ body panels formed of thinner and lighter weight metal structures, the body panels are provided (by stamping processes, for example) with elongated contoured concave grooves or body lines to provide structural strength to the metal panel as is well known in the industry. For example, each side of the automobile may consist of 3 to 4 body panels depending upon whether it is a 2 door or 4 door model. Each panel is provided with 1 or 2 body lines such as an upper and lower body lines which are formed to run lengthwise of the automobile and are juxtaposed to simulate a continuous body line. In some instances decorative molding strips are attached to the body lines or grooves. Generally automobile manufacturers employ the same body line forming equipment for a number of years even though other areas of body style may change. As a result, the profiled surface contour of the body lines remain unchanged for particular manufacturer's models for periods in excess of 3 to 5 years.

When such body lines are damaged as a result of an accident, the time and accuracy involved in repair of such damage becomes extremely important. Presently, to repair such panel body lines to their original contour to match the undamaged body line is difficult if not impossible and time consuming with prior art devices.

Accordingly, a principle desirable object of the present invention is to provide a new and improved manually usable device for abrading a profiled surface contour.

Another desirable object of the present invention is to provide an abrading device which corresponds or matches precisely to the profiled contour of the work piece to be finished.

Another desirable object of the present invention is to provide an abrading device which can be made and used in lengthened or shortened form depending upon the tool length desired.

Another desirable object of the present invention is to provide an abrading device which is uniquely adapted to receive an abrasive material and maintain the abrasive material in conformity with the contour of the surface to be abraded.

Another desirable object of the present invention is to provide a abrasive material having a predetermined thickness whether the abrading material is rough, intermediate or fine particles.

A still further desirable object of the present invention is to achieve the above desirable objects with an essentially simple structure, lending itself to inexpensive mass-production.

These and other desirable objects of the invention will in part appear hereinafter and will in part become apparent after consideration of the specification with reference to the accompanying drawings and the claims.

SUMMARY OF THE INVENTION

In accordance with one aspect of the present invention, there is provided a manually usable device for abrading a profiled surface contour comprising an elongated rigid body having an upper portion of a size and shape that may be conveniently and comfortable held and effectively used with a single hand and a lower elongated portion coextensive with the upper portion. The lower portion is constructed and arranged to terminate in a predetermined profiled exterior surface contour abrading section adapted to receive an abrasive material thereon whereby the profiled surface contour matches the profiled surface contour to be abraded. The lower portion has a cross section transverse to the length which tapers from the profiled surface contour to the upper portion with the upper and lower portions being unitary in cross section. The surface contour abrading section is constructed and arranged to be oversized with respect to a convex-like surface contour section to be abraded or undersized with respect to a concave-like surface contour section to be abraded to thereby provide an interposed space therebetween of predetermined thickness. The abrading member is provided with an upper non-abrasive surface for attachment to the surface contour abrading section and a lower abrasive surface for contact with the profiled surface contour section to be abraded and has a predetermined overall thickness substantially equal to the interposed space.

In accordance with the present invention, a preferred method for producing a manually usable abrading device embodying the principles of the present invention comprises providing a first member section having a profiled surface contour matching the profiled surface contour to be abraded; providing a second member section having a size and shape that may be conveniently and comfortably held and effectively used by a single hand of a user and securing the first and second member sections together to provide an elongated chamber having a cross sectional configuration transverse to the length of the chamber defining an upper handle portion and a lower portion defining the profiled surface contour. The chamber is then secured at one end to form a mold cavity. A mold material such as a curable natural or synthetic elastomeric material is introduced into the mold cavity, the mold secured and the mold material cured to form a solid rigid body which is then removed to provide the abrading device in accordance with the present invention.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein.

Figure 6:
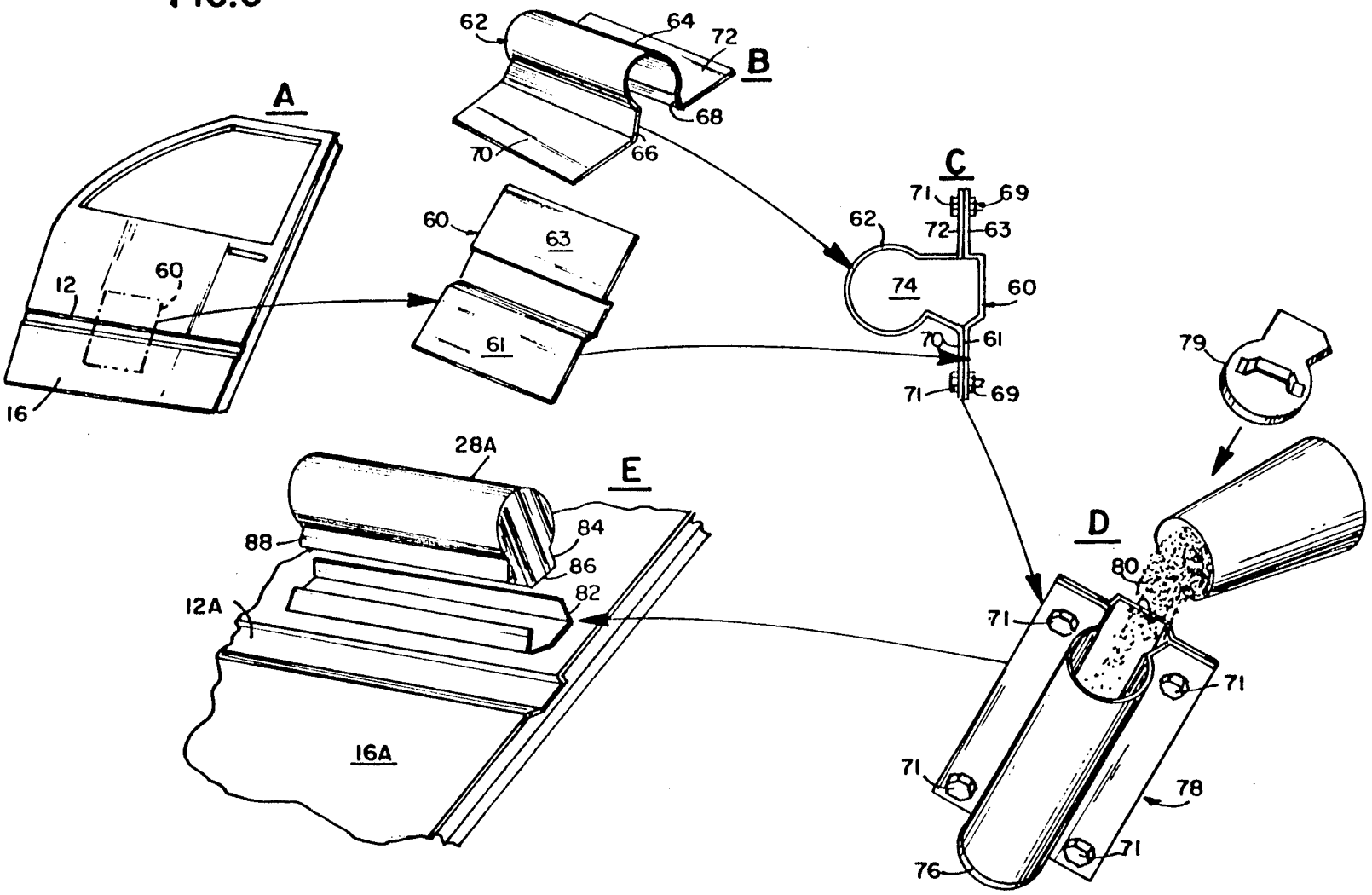

FIG. 6 A–E which schematically represents in stepwise fashion one method of producing an abrasive device embodying the principles of the present invention.

FIG. 7 is an enlarged cross-sectional view of a strip of an abrasive material embodying the principles of the present invention;

FIG. 8 is an enlarged cross-sectional view of an alternate embodiment of a strip of an abrasive material embodying the principles of the present invention;

FIG. 9 is an end plan view, partly in cross-section, of an abrading device embodying the principles of the present invention;

FIG. 10 is an end plan view, partly in cross-section, of an alternate embodiment of an abrading device embodying the principles of the present invention; and FIG. 11 is an end plan view, partly in cross-section, of another alternate embodiment of an abrading device embodying the principles of the present invention.

DETAILED DESCRIPTION OF PREFERRED EMBODIMENTS

Figure 1:
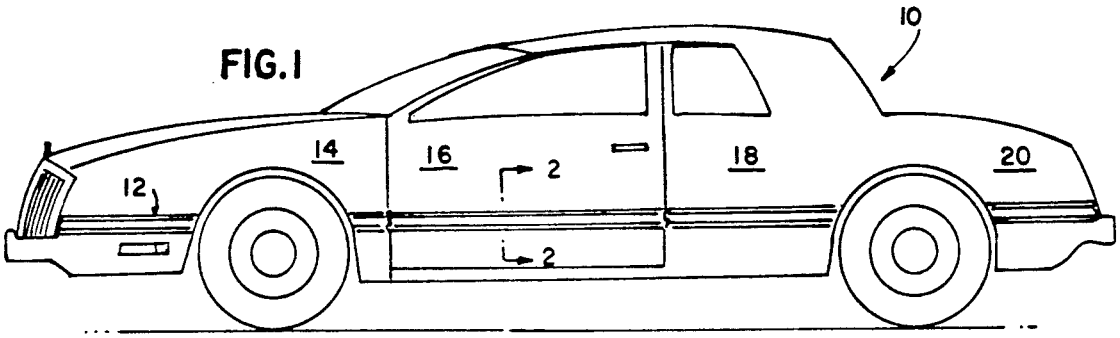
FIG. 1 is a side plan view on a reduced scale showing an automobile with a single body line formed in the panels of the automobile.

Referring now to the drawings and more particularly to FIGS. 1–5, there is represented generally by the numeral 10 of FIG. 1 a modern automobile having a concave groove 12 (also referred to as a body line) disposed in the front quarter panel 14, the front door panel 16, the rear door panel 18 and the rear quarter panel 20 and which are each positioned to form a generally straight line along the side of the automobile.

Figure 2:
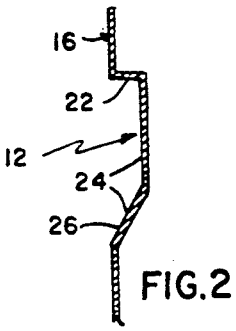
FIG. 2 is an enlarged fragmentary cross-section view taken along the line 2—2 of FIG. 1.

As shown in FIG. 2, the groove 12 disposed in door panel 16 provides a profiled surface contour defined by the configurations of the groove walls 22, 24 and 26.

Referring now more particularly to FIGS. 2–5 of the drawing, there is illustrated generally by the numeral 28 an abrading device embodying the principles of the present invention. As shown, the abrading device 28 comprises an elongated rigid body having an upper portion 30 of a size and shape, illustrated as a generally rounded surface 32, that may be conveniently and comfortable held and effectively used with a single hand 34 (illustrated by the dotted lines) of the user. The abrading device 28 further includes a unitary lower portion 36 which terminates in a predetermined convex-like profiled exterior surface contour defined by surfaces 38, 40 and 42 which match the profiled surfaces 22, 24, and 26 respectively of concave groove 12 to be abraded. The sides 44 and 46 of the lower portion 36 preferably taper inwardly toward the upper portion 30 to improve the gripping effectiveness of the abrading device although this feature is not critical and they may extend directly- or straight to the upper portion. The main requirement of the sides 44 and 46 is that they do not extend over the groove so as to contact the surfaces 48 and 50 adjacent the groove 12 of the panel 16, for example. An abrading means or substance 52 such as, for example, sandpaper is attached to the profiled exterior surfaces 38, 40 and 42 of the lower portion 36 of the abrading device 28. The abrasive media member 52 can be attached by a suitable clamping means 54 which can be an elastic band or a metallic or plastic band provided with an adjustable buckle clamp (not shown).

Figure 4:
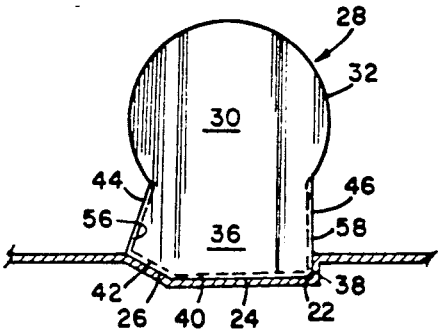
FIG. 4 is an end plan view partly in cross-section of the abrading device of FIG. 3.
Figure 5:
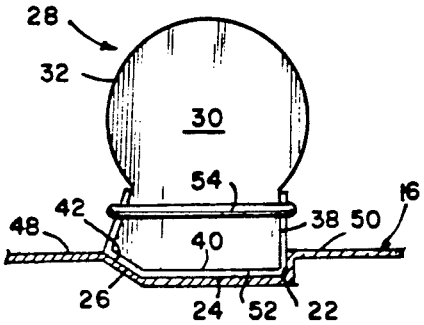
FIG. 5 is an end plan view partly in cross-section of the abrading device of FIGS. 3 and 4 with an abrasive material attached as applied to the work piece of FIG. 2.

In another embodiment of the invention reference now being made to FIG. 4, the lower portion 36 can be undersized as shown by the dotted line 56 by an amount equal to the thickness of the abrasive member 58 such as a strip of sandpaper, for example, (as described further herein) and thereafter the sandpaper attached to the outer surfaces 38, 40 and 42 by a suitable adhesive. In this manner a finer, more accurate and delicate abrading can be provided where such is required by the contour of the surface to be abraded.

Referring now more particularly to FIGS. 7-10, there is illustrated an important feature of the present invention. The structure of the flexible abrasive member 90 (as shown in FIG. 7) comprises a lower surface section 92 formed of a fine abrasive material and an upper or top surface section 94. As shown in FIG. 8, the structure of the flexible abrasive member 96 comprises a lower or bottom surface section 98 formed of a rough abrasive material having a greater thickness than the fine abrasive material 92 of FIG. 7. In this embodiment of the abrasive member 96, the upper section 100 is thinner than the upper section 94 of the abrasive member 90 so that the total thickness 102 and 104 or each abrasive member 90 and 96 respectively are the same. It is understood that when the size of the abrasive material varies from fine to intermediate to rough the thickness of the upper section is varied so that the total thickness of the abrasive members is the same.

In a preferred embodiment, the upper surfaces 94 and 96 are provided with a conventional adhesive material 95 which may be provided with a removable cover member not shown.

The present invention also contemplates a flexible abrasive member which is formed or constructed to have a configuration which matches the configuration of the predetermined profiled surface contour of the lower abrading section of the unitary rigid body member.

As illustrated in FIGS. 9 and 10, the abrasive device 28 is similar in all respects to the abrasive device 28 of FIG. 4 except that the side 46A is more angularly inclined.

The convex-like inner surface contour section formed by the surfaces 38, 40 and 42 is sufficiently undersized with respect to the concave-like surface contour section formed by the surfaces 22, 24, and 26 to be abraded whereby it provides an interposed space 106 therebetween to receive the abrading members 90 and 92 which have equal thicknesses 102 and 104, each equal to the interposed space 106. This feature of the present invention provides an improvement over prior art devices in that it provides for improved and accurate abrading.

Referring now to FIG. 11, there is illustrated an abrasive device 108 having an upper rounded portion 110 and a lower portion 112 terminating in a predetermined profiled concave-like inner surface contour section 114 which matches in an oversized configuration the convex-like surface contour section 116 of the panel member 118 to be abraded to provide an interposed space 106 therebetween to receive the abrasive member 90 which has a thickness 102 equal to the interposed space 106.

In accordance with the present invention a preferred method for producing a manually usable abrading device embodying the principles of the present invention is generally illustrated in a stepwise fashion in FIG. 6 of the drawing. As illustrated in step A, section 60 of door panel 16 containing a length or section of the predetermined profiled concave groove 12 having lateral flanges 61 and 63 is removed to provide a first member section. As shown at step B, a second member section 62 is preferably formed from a metallic plate provided with a configuration having a size and shape that can be conveniently and comfortably grasped and effectively used by a single hand of the user. As illustrated, the second section 62 is provided with a common generally circular upper section 64, a pair of side wall members 66 and 68 which taper inwardly and upwardly to the top section 64 and lateral flange members 70 and 72.

As shown in step C, the first member section 60 and second member section 62 are secured together with the aid of threaded bolts 69 and nuts 71 attached through the lateral flanges to define and form an elongated mold chamber 74. A metallic end piece 76 is attached by welding to the upper section 62 to form the completed mold 78. A suitable cover member 79 is provided for closing the mold during the molding step.

Figure 3:
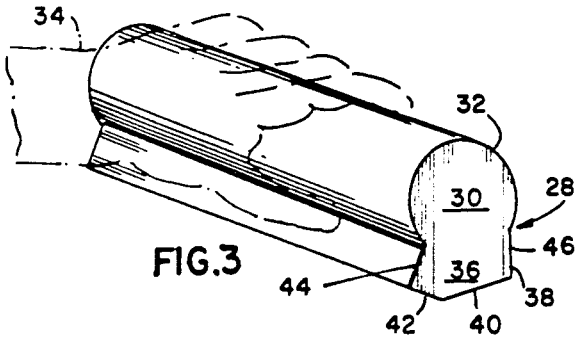
FIG. 3 is a perspective view of an abrading device embodying the principles of the present invention and showing it as it appears held in the hand of a user.

In step D the mold 78 is filled with a mold material 80 such as a curable natural or synthetic elastomeric which when cured forms a solid rigid body 28A which is removed from the mold to provide an abrading device as shown in step E having the structure and configuration of the abrading device 28 of FIG. 3. The abrading device 28A is then provided with a section of sandpaper 82 to at least cover the predetermined profiled surfaces 84, 86, and 88.

The abrading device 28A is then useful for repair abrading of groove 12A in panel 16A which are duplicates of panel 16 and groove 12 from which the abrading device 28A is formed therefrom.

While the invention has been described with respect to one type of body line having a concave contoured surface, it is equally applicable to other types of contoured surfaces including generally convex contoured surfaces as well as various combinations thereof. Additionally, the mold such as mold 78 can be formed by conventional casting techniques wherein the mold is cast having a profiled surface contour portion matching the profiled surface to be abraded and a portion contoured so that the abrading device may be held by the hand of the user.

It is to be understood that the present method contemplates a mold and mold cavity having a substantial length, for example, so that the resulting abrading device can be cut into selected suitable lengths to provide a plurality of abrading devices which substantially reduces the manufacturing costs.

Also, while the invention has been described with respect to abrading or grinding material such as sandpaper, other materials such as conventional smoothing, finishing and polishing materials may also be utilized. As used herein, the term abrading shall include such terms and meanings.

It can be appreciated that the abrading device of the present invention provides for a unique application with respect to motor vehicle repairs. For example, a specific abrading device or devices embodying the principles of the present invention can be provided in the form of a kit containing abrading devices for each different body line on a particular year, model and style of motor vehicle. Such a kit provides access to abrading devices which match precisely to the profiled contours of the body line(s) of a particular or selected motor vehicle.

While the invention has been described with respect to preferred embodiments, it will be apparent to those skilled in the art that changes and modifications may be made without departing from the scope of the invention herein involved in tis broader aspects. Accordingly, it is intended that all matter contained in the above description, or shown in the accompanying drawing shall be interpreted as illustrative and not in limiting sense.

What is claimed is:

1. A manually usable device for abrading a profiled surface contour comprising:

an elongated unitary rigid body member;

said elongated rigid body member having an upper portion of a size and shape that may be conveniently and comfortably held and effectively used with a single hand; and a lower portion terminating in a predetermined profiled surface contour abrading section matching the profiled surface contour section to be abraded;

said surface contour abrading section being oversized with respect to a convex-like surface contour and undersized with respect to a concave-like section to be abraded to provide an interposed space therebetween of predetermined thickness for receiving an abrading member;

said lower portion having a cross-section transverse to the length which tapers from the lateral outer edges of said lower portion of the unitary rigid body member to a portion of the under surface of the upper portion of the unitary rigid body member.

2. A manually usable device for abrading a profiled surface contour comprising:

an elongated unitary rigid body member;

said elongated rigid body member having an upper portion of a size and roundish shape that may be conveniently and comfortably held and effectively used with a single hand;

a lower portion coextensive with said upper portion;

said lower portion terminating in a predetermined profiled surface contour abrading section matching the profiled surface contour section to be abraded;

said surface contour abrading section being oversized with respect to a convex-like surface contour section to be abraded and undersized with respect to a concave-like surface contour section to be abraded to thereby provide an interposed space therebetween of predetermined thickness;

said lower portion having a cross section transverse to the length which tapers from the lateral outer edges of said lower portion of the unitary rigid body member to a portion of the under surface of the upper portion of the unitary rigid body member; and an abrading member having an upper non-abrasive surface attached to the surface contour abrading section and a lower abrasive surface for contact with the profiled surface contour section to be abraded;

said abrading member having a thickness substantially equal to the interposed space.

3. The abrading device according to claim 2 wherein the lower portion terminates in a predetermined profiled concave-like inner surface contour section for matching the profiled convex-like surface contour section of material to be abraded.

4. The abrading device according to claim 2 wherein the lower portion terminates in a predetermined profiled convex-like inner surface contour section for matching the profiled concave-like surface contour section of material to be abraded.

5. The abrading device according to claim 2 wherein the elongated unitary body is formed of a rigid plastic material.

6. The abrading device according to claim 2 including means for releasably attaching an abrading member to the surface contour abrading section of the lower portion of the unitary rigid body member.

7. A manually usable device for abrading a profiled surface contour comprising:

an elongated unitary rigid body member;

said elongated rigid body member having an upper portion of a size and roundish shape that may be conveniently and comfortably held and effectively used with a single hand;

a lower portion coextensive with said upper portion;

said lower portion terminating in a predetermined profiled concave-like inner surface contour section matching the profiled convex-like surface contour section to be abraded;

said concave-like inner surface contour section being oversized with respect to a convex-like surface contour section to be abraded to provide an interposed space therebetween of predetermined thickness;

said lower portion having a cross section transverse to the length which tapers from the lateral outer edges of said concave-like inner surface contour section to a portion of the under surface of the upper portion of the unitary rigid body member; and an abrading member having an upper non-abrasive surface attached to the concave-like inner surface contour section and a lower abrasive surface for contact with the profiled convex-like surface contour section to be abraded;

said abrading member having a thickness substantially equal to the interposed space.

8. A manually usable device for abrading a profiled surface contour comprising:

an elongated unitary rigid body member;

said elongated rigid body member having an upper portion of a size and roundish shape that may be conveniently and comfortably held and effectively used with a single hand;

a lower portion coextensive with said upper portion;

said lower portion terminating in a predetermined profiled convex-like inner surface contour section matching the profiled concave-like surface contour section to be abraded;

said convex-like inner surface contour section being undersized with respect to a concave-like surface contour section to be abraded to provide an interposed space therebetween of predetermined thickness;

said lower portion having a cross section transverse to the length which tapers from the lateral outer edges of said convex-like inner surface contour section to a portion of the under surface of the upper portion of the unitary rigid body member; and an abrading member having an upper non-abrasive surface attached to the convex-like inner surface contour section and a lower abrasive surface for contact with the profiled concave-like surface contour section to be abraded;

said abrading member having a thickness substantially equal to the interposed space.

9. In combination, a manually usable device for abrading a profiled surface contour comprising:

an elongated unitary rigid body member;

said elongated rigid body member having an upper portion of a size and roundish shape that may be conveniently and comfortably held and effectively used with a single hand;

a lower portion coextensive with said upper portion;

said lower portion terminating in a predetermined profiled surface contour abrading section matching the profiled surface contour section to be abraded;

said surface contour abrading section being oversized with respect to a convex-like surface contour section to be abraded and undersized with respect to a concave-like surface contour section to be abraded to thereby provide an interposed space therebetween of predetermined thickness;

said lower portion having a cross-section transverse to the length which tapers from the lateral outer edges of said lower portion of the unitary rigid body member to a portion of the under surface of the upper portion of the unitary rigid body member; and an abrasive member for attaching to the surface contour abrading section comprising:

a strip having a total thickness substantially equal to the interposed space;

an upper non-abrasive surface for attaching to the surface contour abrading section; and a lower abrasive surface;

said lower abrasive surface being selected from the group consisting of fine abrasive material, intermediate abrasive material, and rough abrasive material; and means for releasably attaching the upper non-abrasive surface to the surface contour abrading section of the lower portion of the unitary rigid body member.

10. In a manually usable device for abrading a profiled surface contour containing a surface contour abrading section being oversized with respect to a convex-like surface contour section to be abraded and undersized with respect to a concave-like surface contour section to be abraded to thereby provide an interposed space therebetween of predetermined thickness, the improvement comprising:

an abrasive member for attaching to the surface contour abrading section comprising:

a strip having a total thickness substantially equal to the interposed space;

an upper non-abrasive surface for attaching to the surface contour abrading section; and a lower abrasive surface;

said lower abrasive surface being selected from the group consisting of fine abrasive material, intermediate abrasive material, and rough abrasive material; and means for releasably attaching the upper non-abrasive surface to the surface contour abrading section of the lower portion of the unitary rigid body member.

* * * * *